US006499633B1

(12) United States Patent
Pogmore

(10) Patent No.: US 6,499,633 B1
(45) Date of Patent: Dec. 31, 2002

(54) HANGER WITH INFORMATION MARKER

(75) Inventor: Neil Pogmore, Metro Manilla (PH)

(73) Assignee: Acotex Far East Limited, Hong Kong ( * ) Notice: Subject to any disclaimer, the term of this patent is extended or adjusted under 35 U.S.C. 154(b) by 0 days.

(21) Appl. No.: 09/933,147

(22) Filed: Aug. 20, 2001

(51) Int. Cl.[7] ..... A41D 27/22

(52) U.S. Cl. ..... 223/85; 223/92; 223/95; 40/322

(58) Field of Search ..... 223/85, 98; 40/322

(56) References Cited

U.S. PATENT DOCUMENTS

| | | | | | |
|---|---|---|---|---|---|
| 4,450,639 | A | * | 5/1984 | Duester | 40/322 |
| 5,096,101 | A | | 3/1992 | Norman | |
| 5,383,583 | A | | 1/1995 | Zuckerman | |
| 5,449,099 | A | | 9/1995 | Blanchard | |
| 5,469,995 | A | | 11/1995 | Bredeweg | |
| 5,485,943 | A | | 1/1996 | Zuckerman | |
| 5,524,801 | A | | 6/1996 | Dooley | |
| 5,586,697 | A | | 12/1996 | Johansson | |
| 5,611,469 | A | * | 3/1997 | Eiley et al. | 223/85 |
| 5,628,132 | A | | 5/1997 | Marshall | |
| 5,642,840 | A | | 7/1997 | Abdi | |
| 5,785,216 | A | * | 7/1998 | Gouldson et al. | 223/85 |
| 6,019,260 | A | * | 2/2000 | Gouldson | 223/85 |
| 6,041,984 | A | * | 3/2000 | Gouldson | 223/85 |
| 6,189,746 | B1 | * | 2/2001 | Gouldson | 223/85 |

* cited by examiner

*Primary Examiner*—Rodney M. Lindsey
*Assistant Examiner*—James G Smith
(74) *Attorney, Agent, or Firm*—Lilling & Lilling P.C.

(57) ABSTRACT

An improved information marker for a clothes hanger is disclosed. Between the shoulder and the hook of the hanger, a web is secured. At two or more locations on the web, a profiled surface is created. These profiled surfaces engage with fingers on the interior of an information tab, so as to hold the information tab securely on the web and necessarily the hanger.

8 Claims, 2 Drawing Sheets

HANGER WITH INFORMATION MARKER

FIELD OF THE INVENTION

The invention relates to the clothes industry and, in particular, to a clothes hanger with an information marker tab.

BACKGROUND OF THE INVENTION

In the clothing industry, hangers of all shapes and sizes are used for storing and displaying all types of clothing, including slacks, jackets, coats, sweaters, etc. Because it is not always easy to determine the difference in shades of color or sizes, it is useful to have some type of information marker or tab on the hanger, so as to facilitate identifying the color and/or size of the particular garment.

Therefore, it has been common in the industry to provide hangers with removable (or non-removable) information tabs. In this way, for storage and display purposes, clerks and purchasers can quickly discern pertinent information about the garment by quickly, visually inspecting the information marker or tab.

Over the years, based on a similar concept, different companies have develop varying structures for supporting these information markers.

For example, Eiley (U.S. Pat. No. 5,611,469) identifies a resilient identification clip which is secured over a retaining pin that extends approximately in the region between the shoulder and the hook of the hanger.

A common construction in the industry is a profiled web located in the neck of the hanger between the shoulder and the hook. As demonstrated by Abdi (U.S. Pat. No. 5,642,840), Dooley (U.S. Pat. No. 5,524,801), Bredeweg (U.S. Pat. No. 5,469,995), Blanchard (U.S. Pat. No. 5,449,099), Zuckerman U.S. Pat. No. 5,383,583), and Norman U.S. Pat. No. 5,096,101) the web would have a continuous, but profiled surface. For example, Abdi discloses a triangular cross-section and also a rounded cross-section. In the case of Dooley, the web is bullet shaped. Bredeweg also discloses a bullet shape, as does Blanchard. A narrow head shape is suggested by Norman.

One of the continuing themes in all of these patents is that the profile of the web, regardless of its shape, is continuous throughout its surface.

SUMMARY OF THE INVENTION

Therefore, it is the object of this invention to provide a tab holder on the web, wherein the profiled surface is not continuous along the length. In particular, there are two or more sections of the web which are profiled in order to interact with and hold an information tab, instead of the web having such a profiled surface along its entire length.

DETAILED DESCRIPTION OF THE INVENTION

Figures 1, 2, 3:
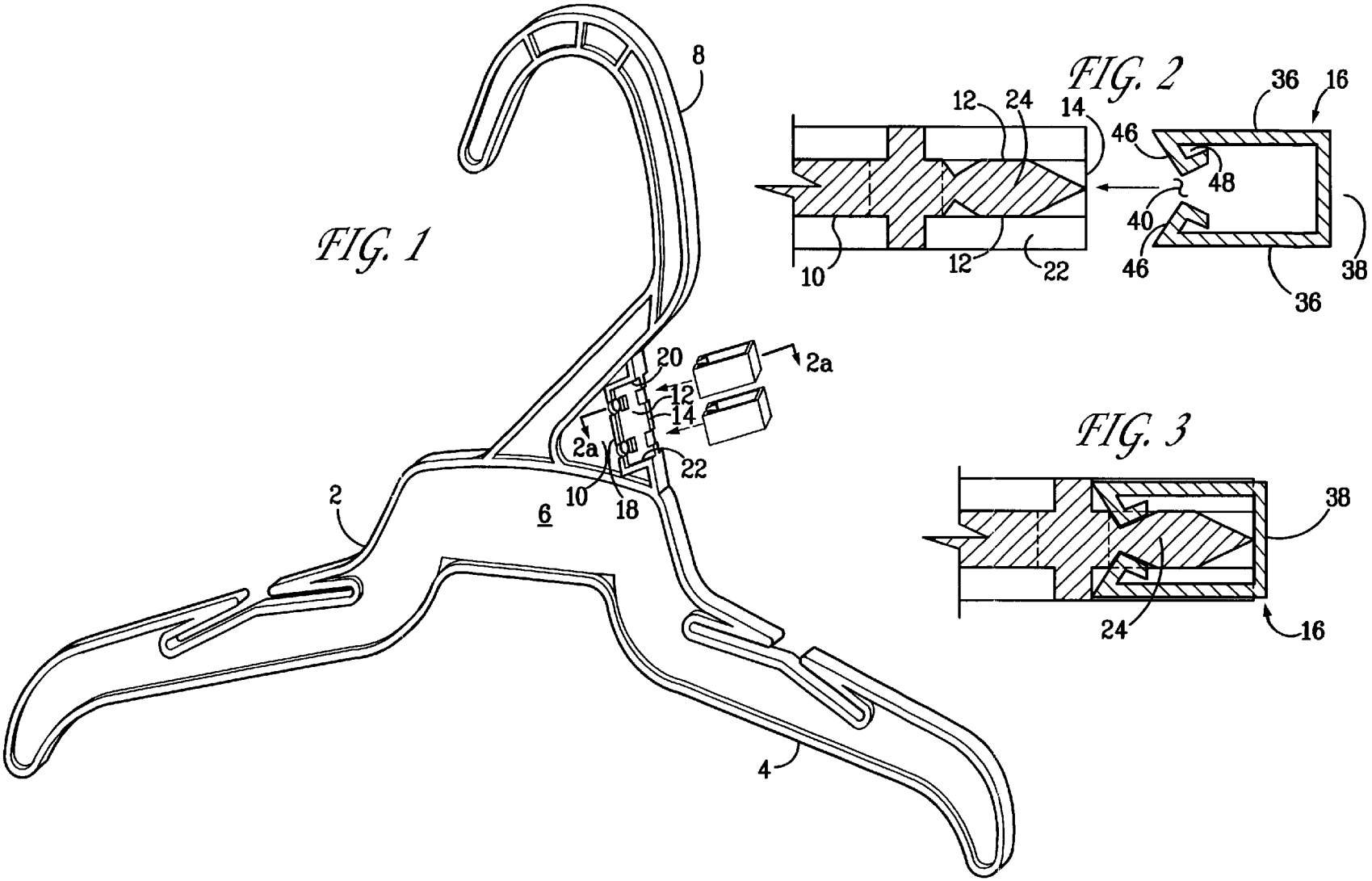
FIG. 1 is a perspective view of a hanger with the information marker tab of this invention.
FIG. 2 is a cross-sectional view taken along line 2—2 of FIG. 1.
FIG. 3 is a cross-sectional view taken along line 3—3 of FIG. 1.
Figure 4:
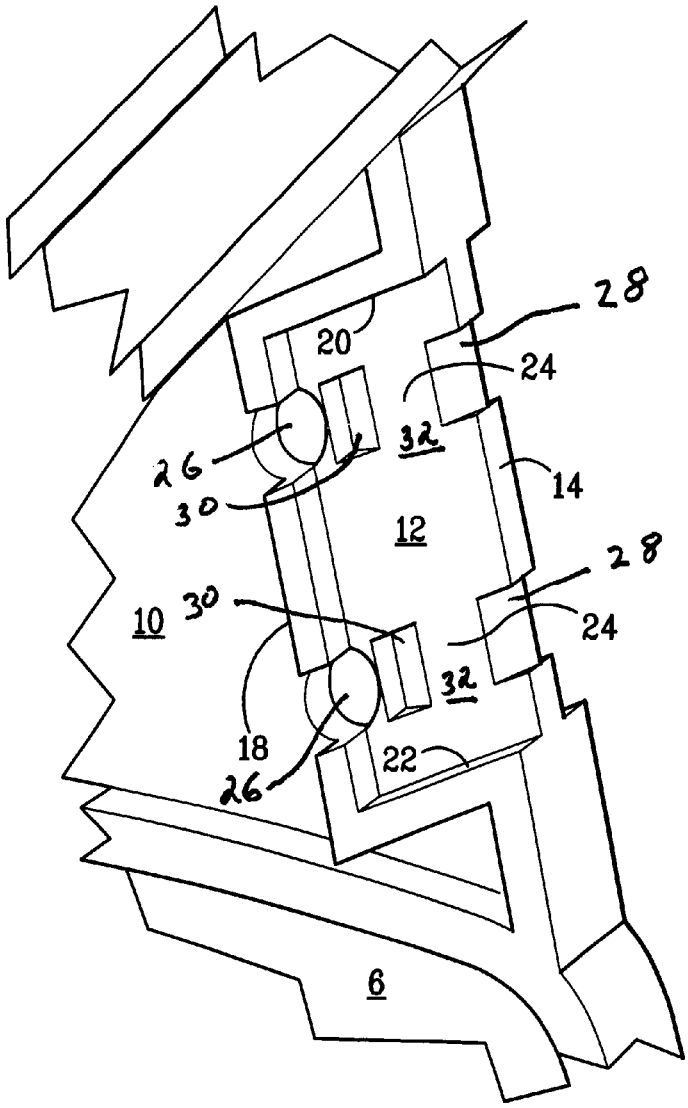
FIG. 4 is a blown up perspective view showing the information tab holder of this invention.
Figure 5:
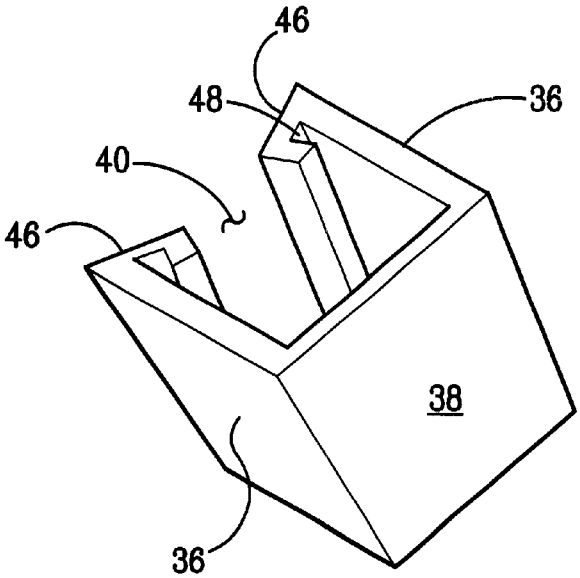
FIG. 5 is a perspective view of the information marker tab of this invention.

The information marker tab of this invention may be used on any type of hanger. As illustrated in the preferred embodiment, the hanger may be of I beam construction with outwardly extending arms 2 and 4 connected in a shoulder region 6. This is conventionally all made integral. Extending upward from the shoulder 6 is a hook 8 of conventional configuration, also made integral.

The exact size and dimensions of the hanger are irrelevant to the particular invention. In the preferred embodiment, the hanger is made of plastic, but may be made of any suitable material, as is known in the industry.

In the neck region 10 of the hanger, a web 12 is formed for defining a tab holder, as is well known in the industry. Preferably, the tab holder is integrally formed with the entire body of the hanger. Preferably, it joins the hook member along one edge and extends from the hook member in the plane of the hanger. The web then defines the tab holder and has at least one free edge and is generally plainer.

The distinguishing characteristic of this invention is that, instead of having a uniform profile along its entire surface, as is done in the prior art, in two or more portions of the surface, the web includes raised surfaces that define a profiled surface.

As more particularly shown in FIGS. 2 and 3 the raised profiles may have a bullet like shape.

In the preferred embodiment, the tab holder constitutes a web 12, as is known in the industry. A free edge 14 of the web is not connected to the hanger and is designed for interaction with the information marker or tab. Opposite the free edge of the web is a base edge 18. Depending on the construction of the hanger, the base edge may be connected to the hanger or not. The connecting sides 20 and 22 of the web are secured respectively to the hanger near the hook and near the top of one of the arms.

At two or more locations along the length of the web, there are profiled surfaces 24 that are defined. This is for the purpose of creating a surface with abutments and shoulders, so that internal ribs on the information marker or tab can interact with the abutments and shoulders and hold the information marker on the web. In the preferred embodiments, the profiled surfaces would be on both faces of the web.

While it is preferable that each of the profiled surfaces have the same shape and configuration, it is within the scope of the invention for the profiled surfaces to have different shapes and configurations. For purpose of describing the preferred embodiment, it will be described with the profiled surfaces being of the same shape and configuration.

According to a preferred embodiment of the invention, the web 12 is of generally rectangular configuration, as is known in the industry. A base edge 18 is along an inside edge and faces the area bounded by the top of the shoulder 6 of the hanger and the lower portion of the curve of the hook 8. In some hangers it may be desirable for this area to be open and in other areas it may be a continuous sheet of material that is integral with the hanger. Thus, in some embodiments, the base edge 18 of the web may be freely disposed and in other embodiments it may be made integral with the hanger.

For reasons that will be hereinafter explained, the base edge has at least one through hole 26. In the preferred embodiment, there are as many through holes 26 as there are profiled surfaces and they are in alignment with the respective profiled surfaces.

Opposite the base edge 18 the web has a free edge 14 that faces outward from the hanger. As will be hereinafter explained, it is this edge of the web over which the information marker or tab is positioned.

On the short sides 20 and 22 of the web, the web is secured to the hanger. This may be accomplished by making the web integral with the hanger. A first connecting side 20 is secured in the vicinity of the hook, whereas the other connecting side 22 is connected in the vicinity of the shoulder or neck of the hanger.

In one embodiment of the invention, the profiled surfaces include upper and lower raised surfaces or abutments 28 and 30 on the face of the web. In such embodiments, the upper and lower raised abutments may be separated by a flattened surface 32.

Alternate embodiments may provide for the profiled surfaces to be bullet shaped or triangular shaped. Regardless of the particular shape of the profiled surface, it should have a surface against which an internal rib of the information marker may bear when the information marker is placed over the web.

According to one preferred embodiment of the invention, the base edge 18 may have a raised border or lip that extends outward or upward from the surface of the web.

The information tab 16 may be of any shape that is known in the industry. Most typically, it is C-shaped or U-shaped.

The information tab is of an elongate shape that is approximately the same length as the length of the tab. Elongate sides 36 are made integral with the connecting base portion 38. This leaves an open end 40, which may be fitted over the web.

Preferably, the information tab is of a heavy-duty plastic, but any suitable material may be used. As is known in the industry, some type of indicia is placed on the outer surface of the base portion 38. In some instances, the indicia might be applied directly on the surface. Alternately, the indicia may be placed on a sheet that is adhered to the surface of the base portion in any suitable manner.

Various types of information can be placed on the indicia applied to the information tab. In some cases, it may be the size or color of the garment. Other times it may be useful to identify the manufacturer or the designer. There may also be instances where the material out of which the garment is made is identified. Any information can be applied as desired.

On the inside surface of the information tab projecting fingers 42 are provided. Ideally, the fingers are angled with respect to the elongate sides 36. When the information marker or tab is positioned over the web, the surfaces of the projecting fingers slide over the surface of the profiled surfaces and raised abutments 28 and 30. Upon final placement of the information marker, the ends 44 of the projecting fingers 42 bear against edges of either or both of the raised abutments 28 or 30. In some embodiments, the fingers may be aligned to bear against the upper abutments and in other embodiments it may be desired for the fingers to bear against the lower abutments. Still other embodiments will require fingers that bear respectively against the upper and the lower abutments. Due to the interaction of the fingers and abutments, they necessarily prevent the information marker from being removed from the web without the use of excessive force.

In the vicinity of the opening 40 of the information marker, the edges 46 of either or both of the elongate sides 36 may be bent over themselves to define a locking region 48. With such a construction, when the information marker is fitted over the web, the raised surface of the base edge 18 may be positioned in the locking region 48 and this too will prevent the information marker from being easily pulled off the web.

To simplify removal of the information marker, the aforementioned holes 26 are made in the base edge 18 of the web. By this means, a straight round instrument may be placed into the hole and may bear against the inner surface of the information marker. This helps to spread its sides, so that the fingers do not interact with the abutments (and so the raised edge of the base edge does not interact with the locking region) and the information marker can be lifted of the web.

By this means, the information tab can be snapped onto the web, but the ribs prevent easy removal, as they bear against the shoulder portions of the enlarged area. If sufficient force is applied, then the tab can be removed. In some embodiments, it may be desired to shape and construct the ribs, so that they come into non-flexible engagement with the shoulders of the enlarged portions and the information tab cannot be removed from the web.

The invention is described in detail with reference to a particular embodiment, but it should be understood that various other modifications can be effected and still be within the spirit and scope of the invention.

I claim:

1. A garment hanger including a information tab, comprising:

said hanger including a body and a hook member connected to said body;

a tab holder formed integrally with said hanger, said tab holder including a web having a free edge not attached to said hanger, first and second connecting sides connected to said hanger, and a base edge opposite said free edge, wherein said web has two or more profiled surfaces extending from said base edge toward said free edge; and said information tab having an information marking on an outer surface thereof, and said information tab having an interior region cooperatively engaging said profiled surfaces of said web of said tab holder.

2. A garment hanger according to claim 1, wherein said information tab further includes fingers positioned in said interior region of said information tab and bearing against said profiled surfaces of said web.

3. A garment hanger according to claim 1, wherein said base edge of said tab holder has a raised surface which engages said information tab.

4. A device for identifying information about clothing, comprising:

a garment hanger including a body and a hook member connected to said body;

a tab holder formed integrally with said hanger, said tab holder including a web having a free edge not attached to said hanger, first and second connecting sides connected to said hanger, and a base edge opposite said free edge, wherein said web has two or more profiled surfaces extending from said base edge toward said free edge;

and, an information tab having a U or C-shaped profile with elongate facing sides, a connecting base portion and an open end, wherein information about said clothing is placed on an outer surface of said base portion, and means on interior surfaces of said elongate sides for engaging said profiled surfaces of said web when said information marker is placed over said tab holder.

5. A device according to claim 4, wherein said information tab includes fingers angularly positioned on said interior surfaces of said elongate sides.

6. A device according to claim 4, wherein said profiled surfaces on said web include upper and lower raised abutments.

7. A device according to claim 5, wherein said profiled surfaces on said web include upper and lower raised abutments and wherein ends of said fingers of said information tab bear against outer edges of respective raised abutments on said web.

8. A device according to claim 4, wherein said base edge of said web has a raised surface interacting with a locking region at said open end of said information tab.

* * * * *